US011089940B2

(12) United States Patent
Porcelli

(10) Patent No.: US 11,089,940 B2
(45) Date of Patent: Aug. 17, 2021

(54) DEVICE FOR DRYING AND POLISHING ITEMS SUCH AS GLASSES AND CUTLERY

(71) Applicant: MT Innovations Pty Ltd, Melbourne (AU)

(72) Inventor: Tommaso Porcelli, Ventimiglia (IT)

(73) Assignee: MT Innovations Pty Ltd, Melbourne (AU)

( * ) Notice: Subject to any disclaimer, the term of this patent is extended or adjusted under 35 U.S.C. 154(b) by 0 days.

(21) Appl. No.: 17/097,980

(22) Filed: Nov. 13, 2020

(65) Prior Publication Data

US 2021/0059501 A1 Mar. 4, 2021

Related U.S. Application Data

(63) Continuation-in-part of application No. 16/466,577, filed as application No. PCT/AU2017/051445 on Dec. 22, 2017.

(30) Foreign Application Priority Data

Jan. 10, 2017 (AU) ..... 2017900049

(51) Int. Cl.
*A47L 21/02* (2006.01)
*A47L 15/48* (2006.01)

(52) U.S. Cl.
CPC ..... *A47L 21/02* (2013.01); *A47L 15/48* (2013.01); *A47L 2501/14* (2013.01); *A47L 2501/265* (2013.01)

(58) Field of Classification Search
CPC ..... A47L 21/02; A47L 15/48; A47L 15/0065; A47L 2501/14; A47L 2501/265; A46B 13/04; A46B 2200/3086
See application file for complete search history.

(56) References Cited

U.S. PATENT DOCUMENTS 872,702 A 12/1907 Vodoz
3,516,108 A 6/1970 Loeffler
(Continued)

FOREIGN PATENT DOCUMENTS

CN 201333018 Y 10/2009
CN 103272810 B 9/2013
(Continued)

OTHER PUBLICATIONS

International Search Report and Written Opinion for corresponding App. No. PCT/AU2017/051445, dated Feb. 8, 2018, 11 pages.
(Continued)

*Primary Examiner* — Natasha N Campbell
(74) *Attorney, Agent, or Firm* — Armstrong Teasdale LLP

(57) ABSTRACT

A device for drying and polishing a plurality of items including glasses and cutlery is provided. The device includes a plurality of movable cleaning elements configured to at least one of dry and polish the items and an enclosure defining a chamber, the movable cleaning elements being within the chamber. The enclosure includes a first aperture at a first enclosure location, a second aperture at a second enclosure location, a third aperture at a third enclosure location, and a channel assembly located in the chamber. The first aperture is adapted to receive a first item, the second aperture is adapted to receive a second item, and the third aperture is adapted to enable the second item to exit the chamber. The channel assembly defines a channel path between the second aperture and the third aperture.

18 Claims, 15 Drawing Sheets

(56) References Cited

U.S. PATENT DOCUMENTS

| | | | | |
|---|---|---|---|---|
| 8,506,360 | B1 | 8/2013 | Larson | |
| 2005/0072449 | A1* | 4/2005 | Alpert | A47L 15/4242 134/25.1 |
| 2006/0011220 | A1* | 1/2006 | Mueller | B08B 3/00 134/45 |
| 2008/0099043 | A1* | 5/2008 | Barnhill | A46B 13/04 134/6 |
| 2014/0002595 | A1 | 9/2014 | Nuttall et al. | |

FOREIGN PATENT DOCUMENTS

| | | | | |
|---|---|---|---|---|
| IT | 1269008 | B | 3/1997 | |
| WO | WO-0228265 | A1 * | 4/2002 | A47L 21/02 |
| WO | 2003009965 | A2 | 2/2003 | |

OTHER PUBLICATIONS

CPI, SilvershineTM, Commercial Cutlery Dryer/Polisher Sanitizer Specifications, Accessed Mar. 15, 2021.
CPI, SilvershineTM, Commercial Stemware Dryer/Polisher Specifications, Accessed Mar. 15, 2021.

* cited by examiner

DEVICE FOR DRYING AND POLISHING ITEMS SUCH AS GLASSES AND CUTLERY

CROSS-REFERENCE TO RELATED APPLICATIONS

The current disclosure is a continuation-in-part of U.S. application Ser. No. 16/466,577, filed Jun. 4, 2019, which is a National Stage Entry of International Application No. PCT/AU2017/051445, filed Dec. 22, 2017, which claims priority to Australian Patent Application No. 2017900049, filed Jan. 10, 2017, the contents of which are hereby incorporated by reference, in their entireties and for all purposes, herein.

FIELD OF THE DISCLOSURE

The present disclosure relates to a device for drying and/or polishing items such as glasses and cutlery.

BACKGROUND OF THE DISCLOSURE

Drying and polishing cutlery and glasses is one of the core roles and responsibilities for those in the hospitality industry. The need for drying and polishing is created due to the streaks and spots that are frequently left on the glasses and cutlery after cleaning, particularly when the glasses and cutlery are cleaned using a dishwasher. Due to a lack of an effective commercial solution, the required drying and polishing of cutlery is commonly performed manually with a rag. Each item is held by hand, and while holding the item, is dried by wiping the item with the rag. This traditional method for drying and polishing cutlery and glasses is time consuming and also creates potential hygiene issues due in part to frequent reuse of the drying rag.

Devices for drying and polishing items such as glasses and cutlery have previously been proposed but have generally been ineffective. Prior devices are large, complicated devices and are generally inconvenient to use. For example, the device disclosed in EP1532921 can only handle cutlery and not glasses. U.S. Pat. No. 6,907,893 is configured for cleaning bottles within a sealed enclosure and would not be appropriate to use for rapidly drying and polishing glasses and cutlery, neither would U.S. Pat. No. 7,604,012, which also includes means for washing the items.

Furthermore, previous devices have suffered from a lack of the control of steam within the devices. For example, previous devices have not included releasing steam only when the items for drying and/or polishing are inserted into the device.

Even further, previous devices have also suffered because the previous devices are generally bulky devices that can take up a lot of space in kitchens, including considerable space on kitchen countertops which would be better used to prepare food for restaurant customers. Further, the previous devices suffer from the inability to both polish and dry stemware and automatically dry and polish cutlery in a single, compact device.

Examples of the disclosure seek to solve, or at least ameliorate, one or more disadvantages of previous devices for drying and polishing items such as glasses and cutlery, or at least provide a useful alternative.

SUMMARY OF THE DISCLOSURE

In one embodiment, a device for drying and polishing a plurality of items including glasses and cutlery is provided.

The device includes (i) a plurality of movable cleaning elements configured to at least one of dry and polish the items, the plurality of movable cleaning elements including at least one first movable cleaning element, and at least one second movable cleaning element and (ii) an enclosure defining a chamber, wherein the at least one first movable cleaning element and the at least one second movable cleaning element are located in different positions in the chamber. The enclosure includes (i) a first aperture at a first enclosure location, the first aperture adapted to receive a first item of the plurality of items, wherein the at least one first movable cleaning element is proximate the first aperture to at least one of polish and dry the first item when the first item is inserted into the chamber through the first aperture, (ii) a second aperture at a second enclosure location, the second aperture adapted to enable a second item of the plurality of items to be inserted into the chamber, (iii) a third aperture at a third enclosure location, the third aperture adapted to enable the second item of the plurality of items to exit the chamber, and (iv) a channel assembly located in the chamber proximate the at least one second movable cleaning element, the channel assembly defining a channel path, the channel path extending between the second aperture and the third aperture, wherein the second item of the plurality of items is at least one of polished and dried by the at least one second movable cleaning element as the second item of the plurality of items moves along the channel assembly path between the second and third apertures.

In another embodiment, a device for drying and polishing a plurality of items including glasses and cutlery is provided. The device includes (i) a plurality of movable cleaning elements configured to at least one of dry and polish the items, the plurality of movable cleaning elements including at least one first movable cleaning element, and at least one second movable cleaning element, (ii) an enclosure defining a chamber, wherein the at least one first movable cleaning element and the at least one second movable cleaning element are located in different positions in the chamber, and (iii) a selectively operable steam distribution system configured to apply steam within the chamber to at least one of (a) the at least one of the first and second cleaning elements and (b) the items inserted into at least one of the first and second apertures, wherein the steam distribution system is operable upon insertion of the items into at least one of the first and second apertures. The enclosure includes (i) a first aperture at a first enclosure location, the first aperture adapted to receive a first item of the plurality of items, wherein the at least one first movable cleaning element is proximate the first aperture to at least one of polish and dry the first item when the first item is inserted into the chamber through the first aperture, (ii) a second aperture at a second enclosure location, the second aperture adapted to enable a second item of the plurality of items to be inserted into the chamber, (iii) a third aperture at a third enclosure location, the third aperture adapted to enable the second item of the plurality of items to exit the chamber, and (iv) a channel assembly located in the chamber proximate the at least one second movable cleaning element, the channel assembly defining a channel path, the channel path extending between the second aperture and the third aperture, wherein the second item of the plurality of items is at least one of polished and dried by the at least one second movable cleaning element as the second item of the plurality of items moves along the channel assembly path between the second and third apertures.

BRIEF DESCRIPTION OF THE DRAWINGS

Preferred embodiments of the disclosure will be further described, by way of non-limiting examples only, with reference to the accompanying drawings in which.

DETAILED DESCRIPTION

Figure 1:
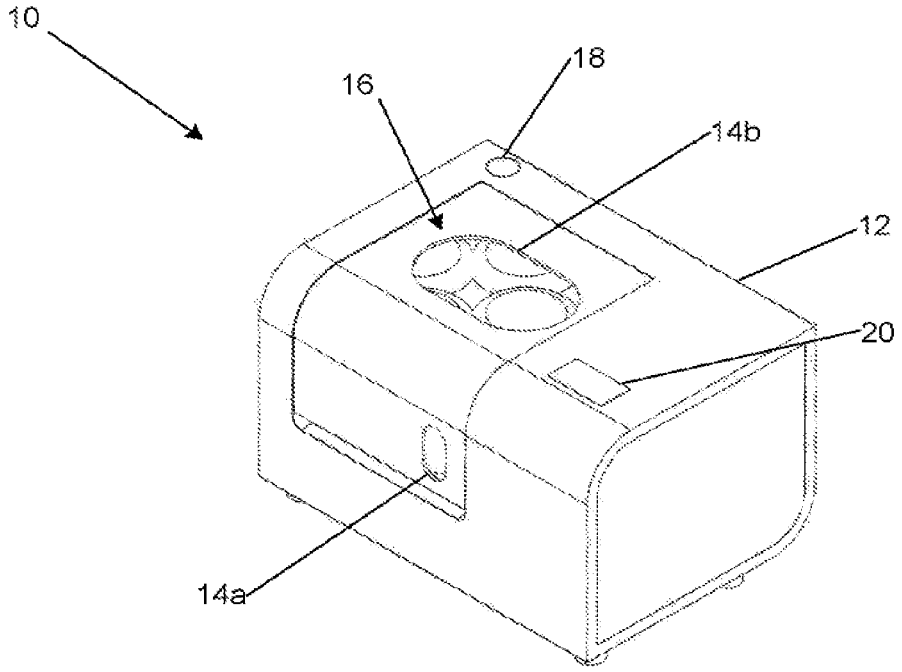
FIG. 1 is a perspective view of a device of one embodiment of the disclosure.

With reference to FIG. 1, there is shown a device 10 for drying and polishing items such as glasses and cutlery according to a preferred embodiment of the disclosure.

The device includes an enclosure 12 having apertures 14*a*, 14*b* through which an end of the items can be inserted, a plurality of movable cleaning elements 16 within the enclosure 12 for drying and/or polishing the items, and a selectively operable steam distribution system 34 (to be described further below) for applying steam within the enclosure 12 to at least one of the cleaning elements 16 and/or the items, whereby the cleaning elements 16 dry and/or polish the items. When the items are selectively inserted into either aperture 14*a* or 14*b*, the user holds the item adjacent the associated cleaning elements while the item is being polished and dried. The device user then removes the polished and dried items through the aperture.

Figure 2:
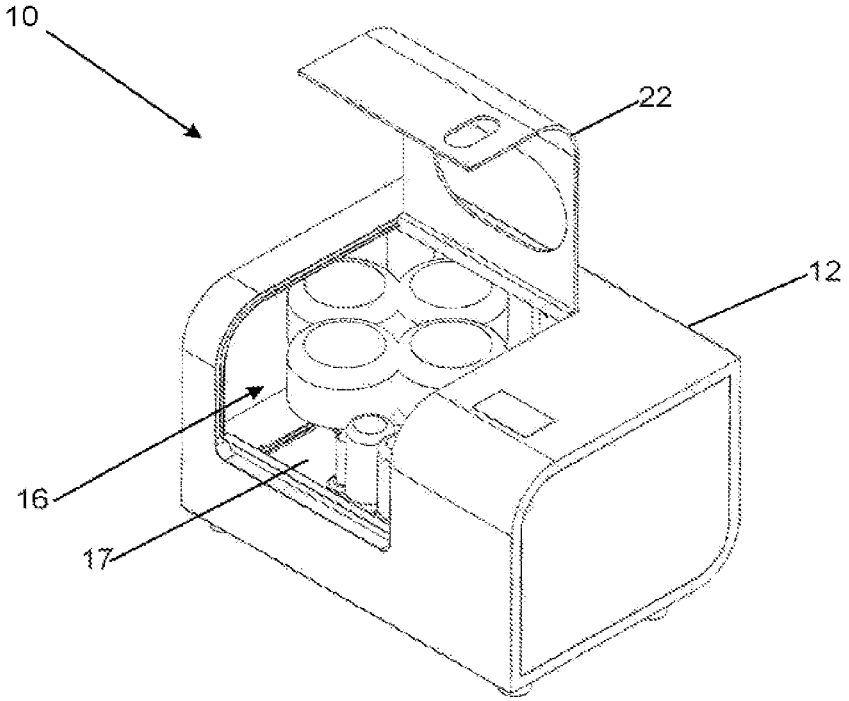
FIG. 2 is a perspective view of the device with an enclosure cover opened.
Figure 3:
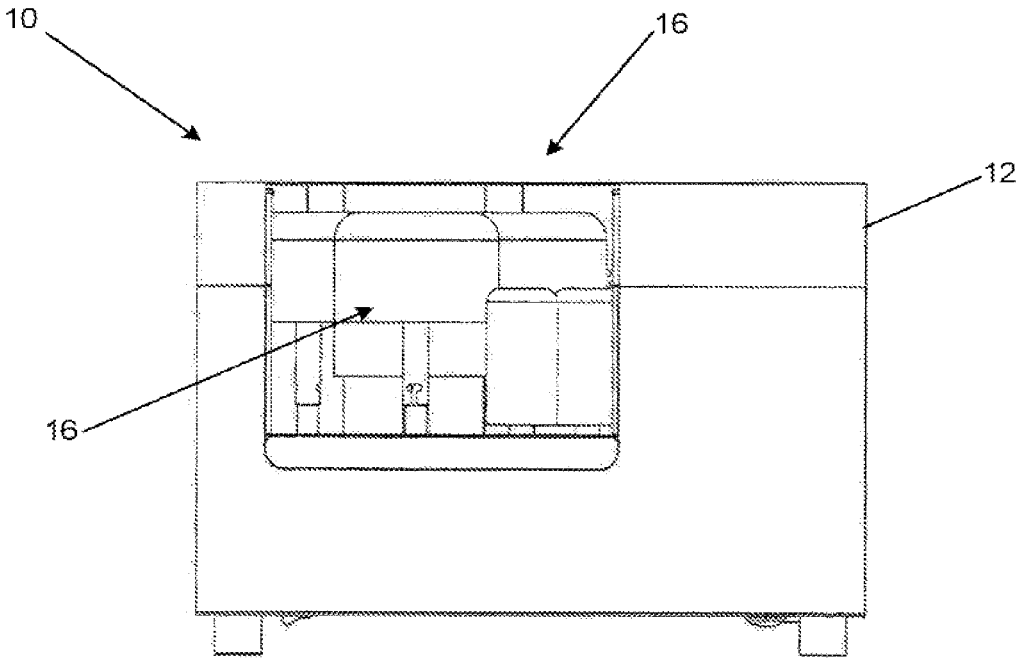
FIG. 3 is a side view of the device with the cover removed.
Figure 4:
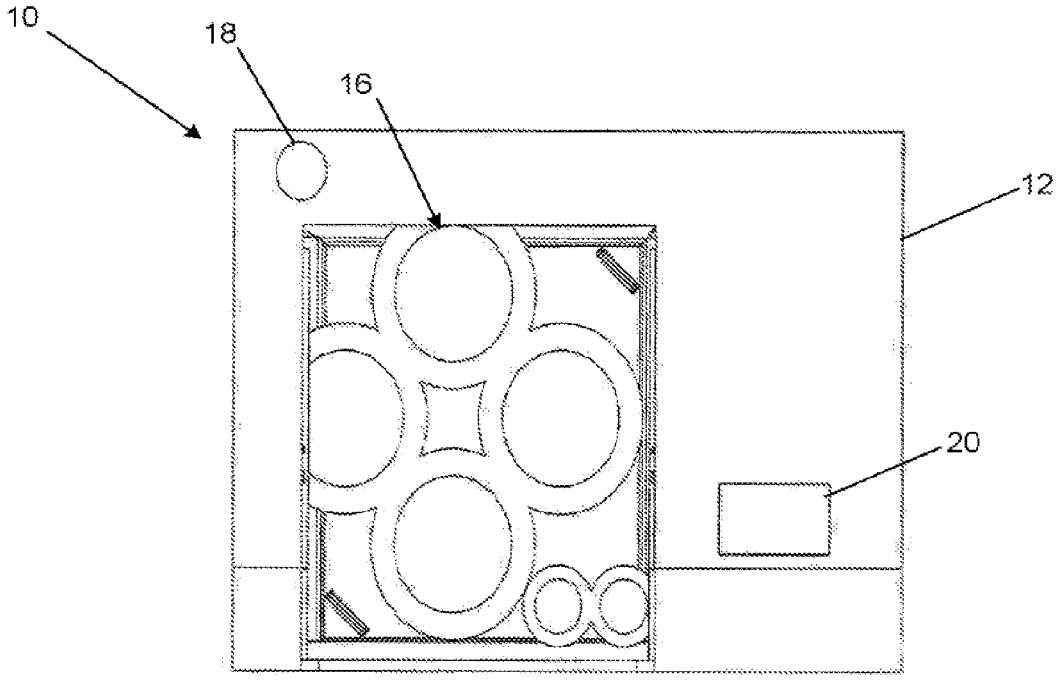
FIG. 4 is a plan view of the device with the cover removed.

The enclosure 12 is fitted with an operation switch 18 and a display screen 20, which may be in the form of a LCD screen. The enclosure 12 also includes a lid 22, openable, as illustrated in FIG. 2, for access to an internal area of the device 10 and the cleaning elements 16. The device 10 is preferably configured to cease operation upon opening of the lid 22. To facilitate cleaning, a removable rubber tray 17 is received in a base of the enclosure 12 for collecting debris.

Figure 5:
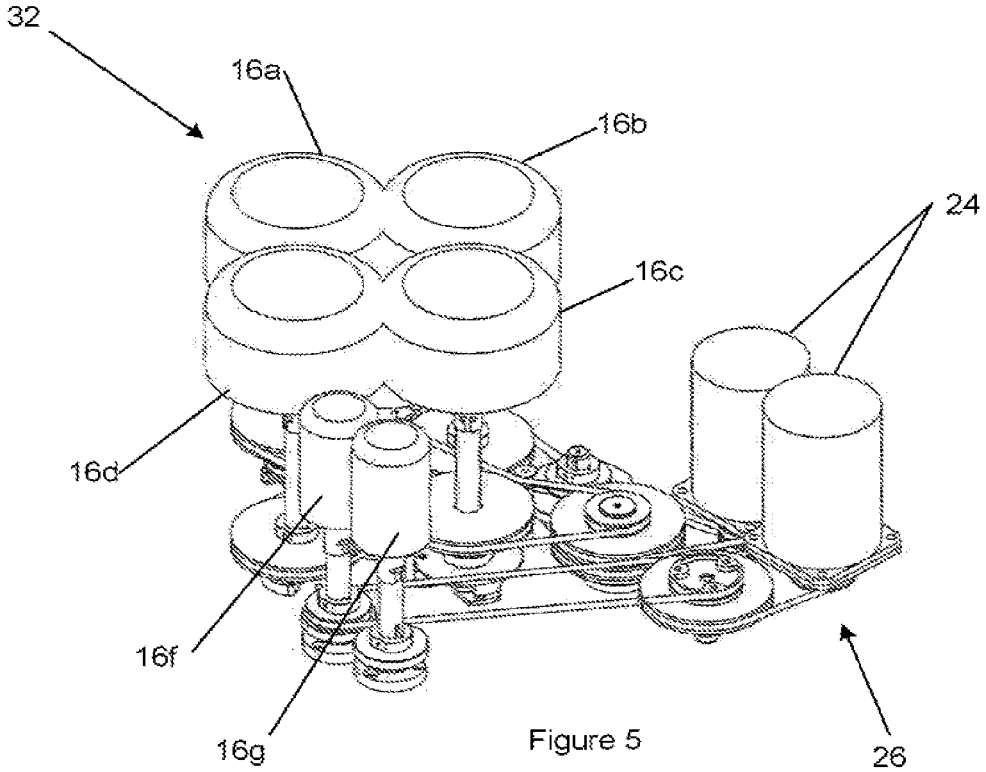
FIG. 5 is a perspective view of a rotating assembly removed from the device.
Figure 6:
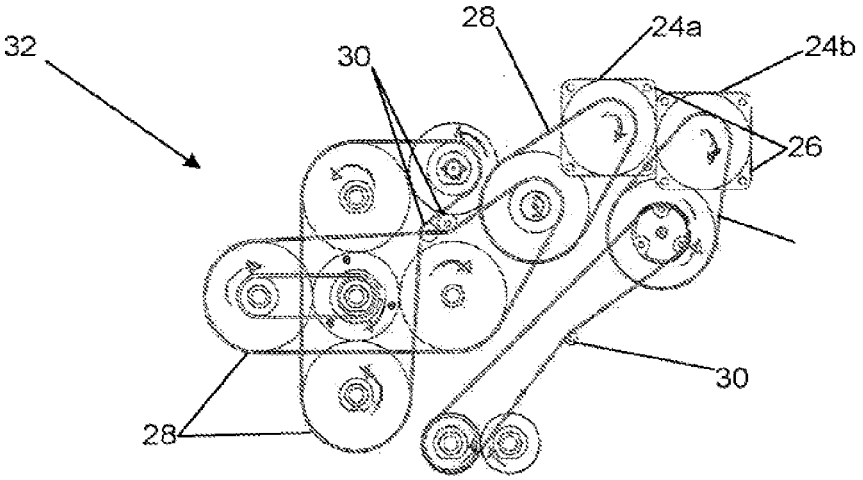
FIG. 6 is an underneath view of the rotating assembly.

FIGS. 5 and 6 illustrate a rotating assembly 32 of the device 10 in more detail. In the embodiment illustrated, the cleaning elements 16 are driven from two electric drives 24, which may take any commercially available form. As shown in FIG. 6, a first electric drive is configured for driving a first set of cleaning elements 16*a*, 16*b*, 16*c*, 16*d*, 16*e* configured for drying/polishing glasses, and a second electric drive is configured for driving a second set of cleaning elements 16*f*, 16*g* configured for drying/polishing cutlery. Of the first set of cleaning elements, cleaning element 16*a* is centrally disposed and configured for cleaning an internal area of a glass, while cleaning elements 16*b*, 16*c*, 16*d*, 16*e* are configured for cleaning an external area. It should be noted that in FIGS. 1 to 5, 7 and 8, central cleaning element 16*a* has been removed for clarity. Also, in an alternative configuration, a single electric drive may be used in conjunction with a system for selectively engaging the first and second sets of cleaning elements as required.

The electric drives 24 rotate pulleys 26 which, via belts 28, causes rotation of the shafts on which the cleaning elements 16 are mounted. Idlers 30 may be provided for guiding/directing the belt. Preferably, some of the cleaning elements 16 within the first and second sets are configured for counter rotation to improve drying/polishing of the glasses/cutlery. To achieve this, gears may be used to couple cleaning elements or other components within the rotating elements and transfer rotational direction as required.

It will be appreciated that not all of the cleaning elements 16 need be directly rotated by belts 28 and that some of the cleaning elements, such as cleaning elements 16*f*, 16*g* illustrated, may instead be coupled to a driven cleaning element by gears to enable rotation and to transfer the direction of rotational motion from one cleaning element to the next.

Figure 7:
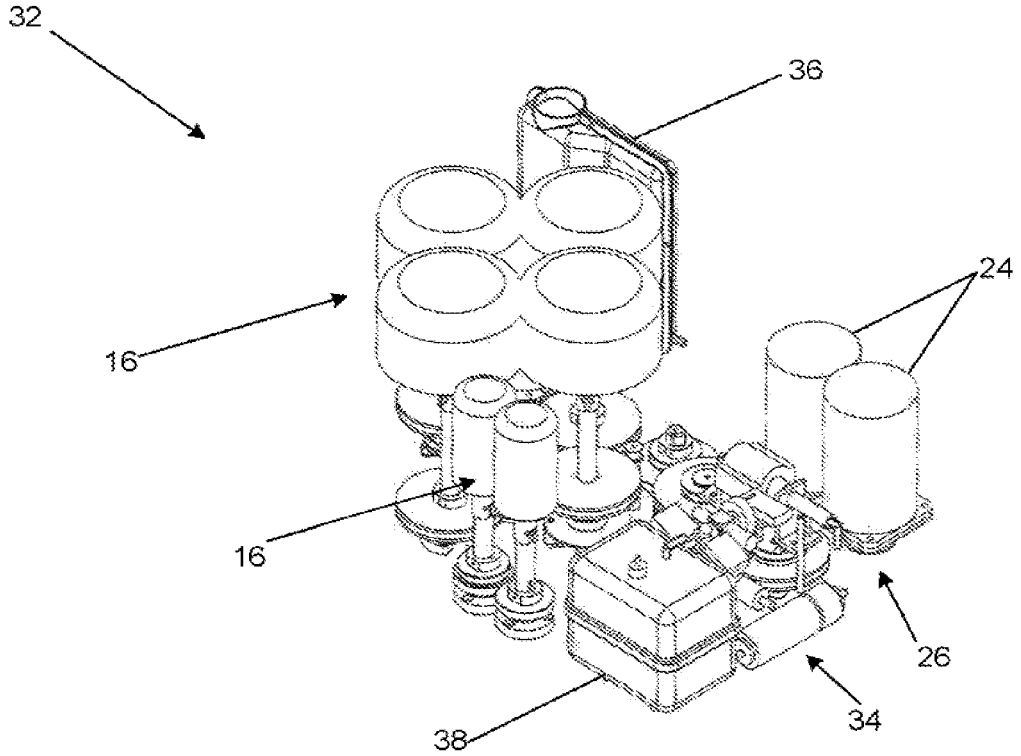
FIG. 7 is a perspective view of the internal components of the device.
Figure 8:
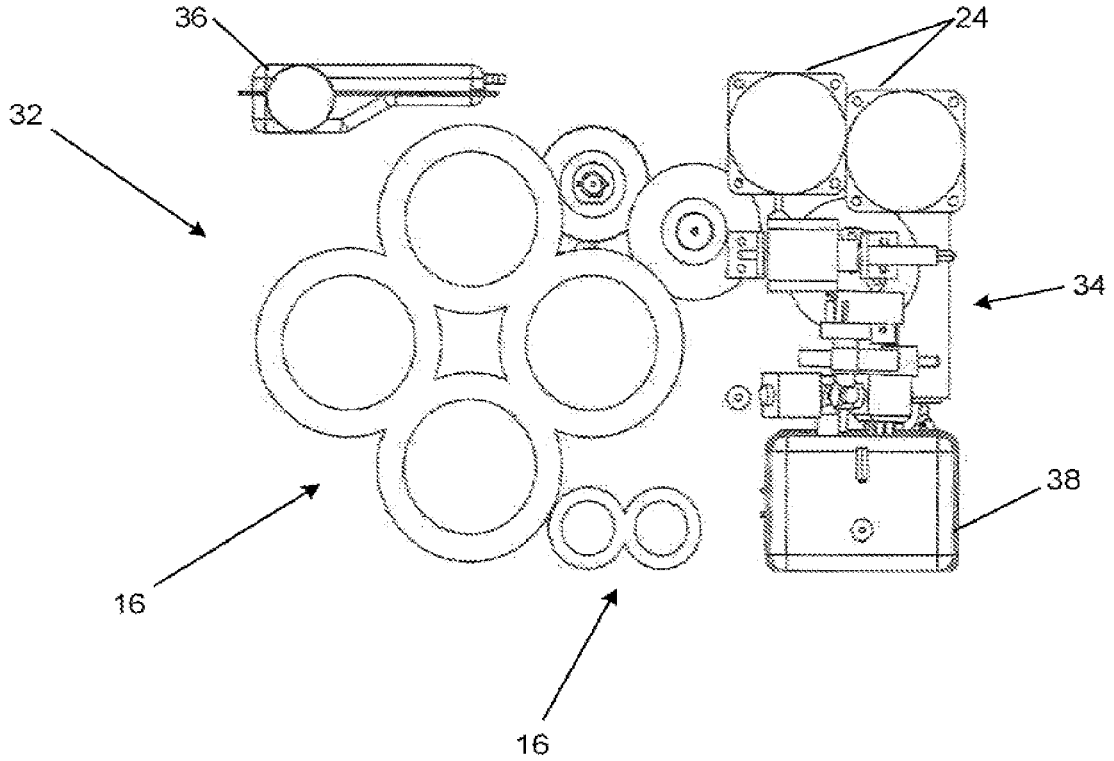
FIG. 8 is a plan view of the internal components of the device.

FIGS. 7 and 8 illustrate the rotating assembly 32 with a steam distribution system 34 fitted thereto. The steam distribution system 34 includes a water reservoir 36, though in other embodiments, such as that shown in FIG. 10, a mains water connection 37 may be provided. The steam distribution system 34 includes a boiler 38 for heating the water, a pump 42, and valves for distributing the steam and maintaining a required pressure in the system.

Figure 9:
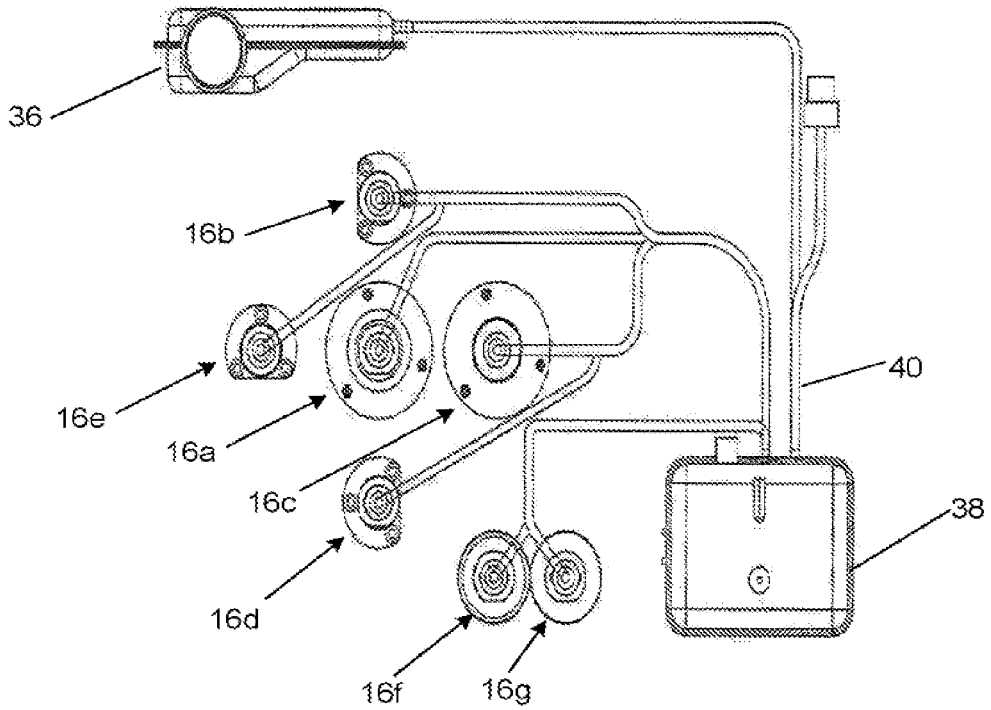
FIG. 9 is a schematic layout drawing of a steam generation system of the device.
Figure 10:
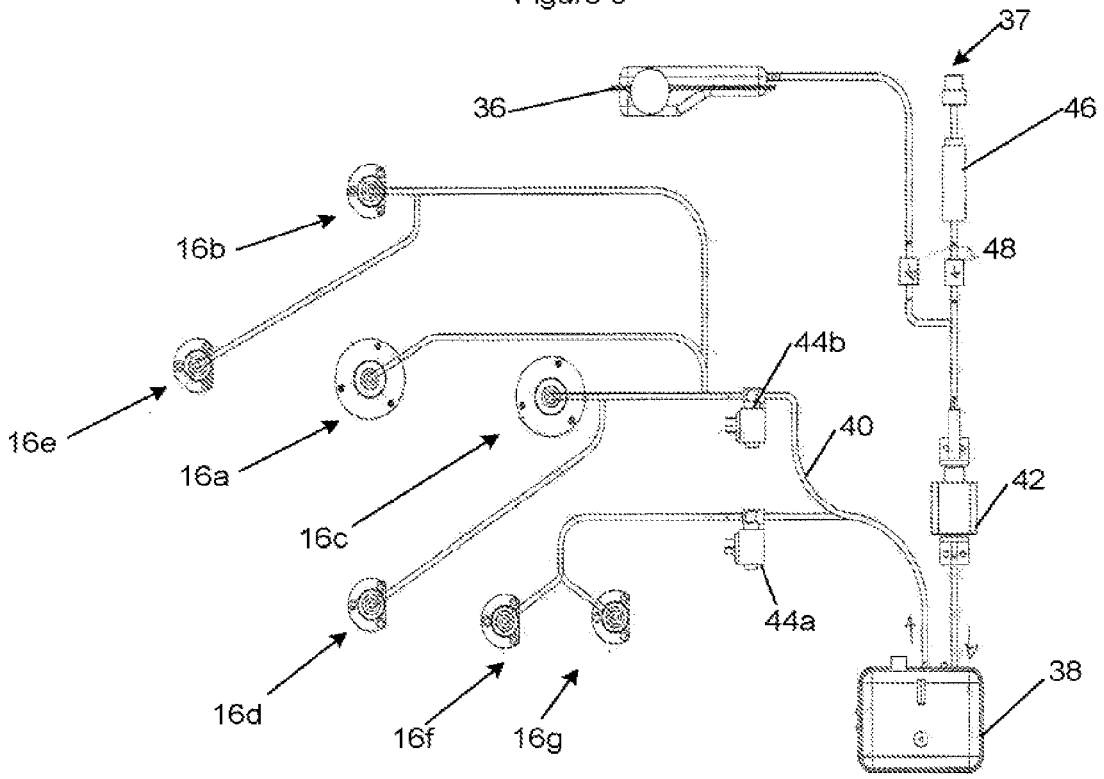
FIG. 10 is a detailed layout drawing of the steam generation system.

FIGS. 9 and 10 schematically illustrate the interaction between the steam distribution system 34 and the cleaning elements 16. It can be seen that each cleaning element is in communication with the boiler 38 via conduits 40 so that steam can be distributed onto the cleaning element 16 or directly onto the item to be dried/polished. In other embodiments, not every cleaning element may be in communication with the boiler 38 for the distribution of steam. In such examples, cleaning elements may be steam free, or a steam nozzle may be disposed proximal to a number of cleaning elements and provide steam either onto the cleaning elements or directly onto the item.

A pump 42 is provided for distributing the steam. Control valves 44*a*, 44*b* are also provided to control distribution of steam between cleaning elements configured for use with cutlery and cleaning elements for use with glasses.

For safety, a pressure reducer 46 is provided on a mains water intake, with one-way valves 48 used to control flow of water from the reservoir 36 (or water intake) and to the pressure reducer 46. Also, a flow limiter may be provided to limit the amount of steam that can be applied within the enclosure 12.

The steam distribution system 34 is operable on detection of an end of said items being inserted into the enclosure 12. In some embodiments, sensors may be used to detect an end of said items being inserted into the enclosure 12. In the illustrated embodiment, the steam distribution system 34 is operable upon an end of one of said items being brought into contact with at least one cleaning element 16. In this regard, the steam distribution system 34 is operable on applying pressure to at least one of the cleaning elements 16 via applying pressure to the item once inserted within the enclosure 12, for example by pressing an upturned glass downwardly onto a cleaning element.

Within the cleaning elements for use with glasses, only some of the rotating elements may be configured as "switchable", i.e. configured so that by applying pressure thereto causes activation of the steam distribution system 34. In the illustrated example, only internal cleaning element 16*a*, which is configured for cleaning the inside of a glass, and external cleaning element 16*c*, which is configured for cleaning an external area of the glass are so configured, with cleaning elements 16*b*, 16*d*, 16*e* being provided without a switch. Exerting pressure on either cleaning element 16*a* or 16*c* will result in steam being applied to all of the cleaning elements in the first set, i.e. 16*a*, 16*b*, 16*c*, 16*d* and 16*e*, resulting in both external and internal cleaning of the glass.

With "unswitched" cleaning elements 16*b*, 16*d*, 16*e* steam can still be applied to those cleaning elements, though the steam is only applied on operation of the switches associated with cleaning elements 16*a*, 16*c*. Such an arrangement can reduce manufacturing costs and complexity without adversely affecting performance.

Figure 11:
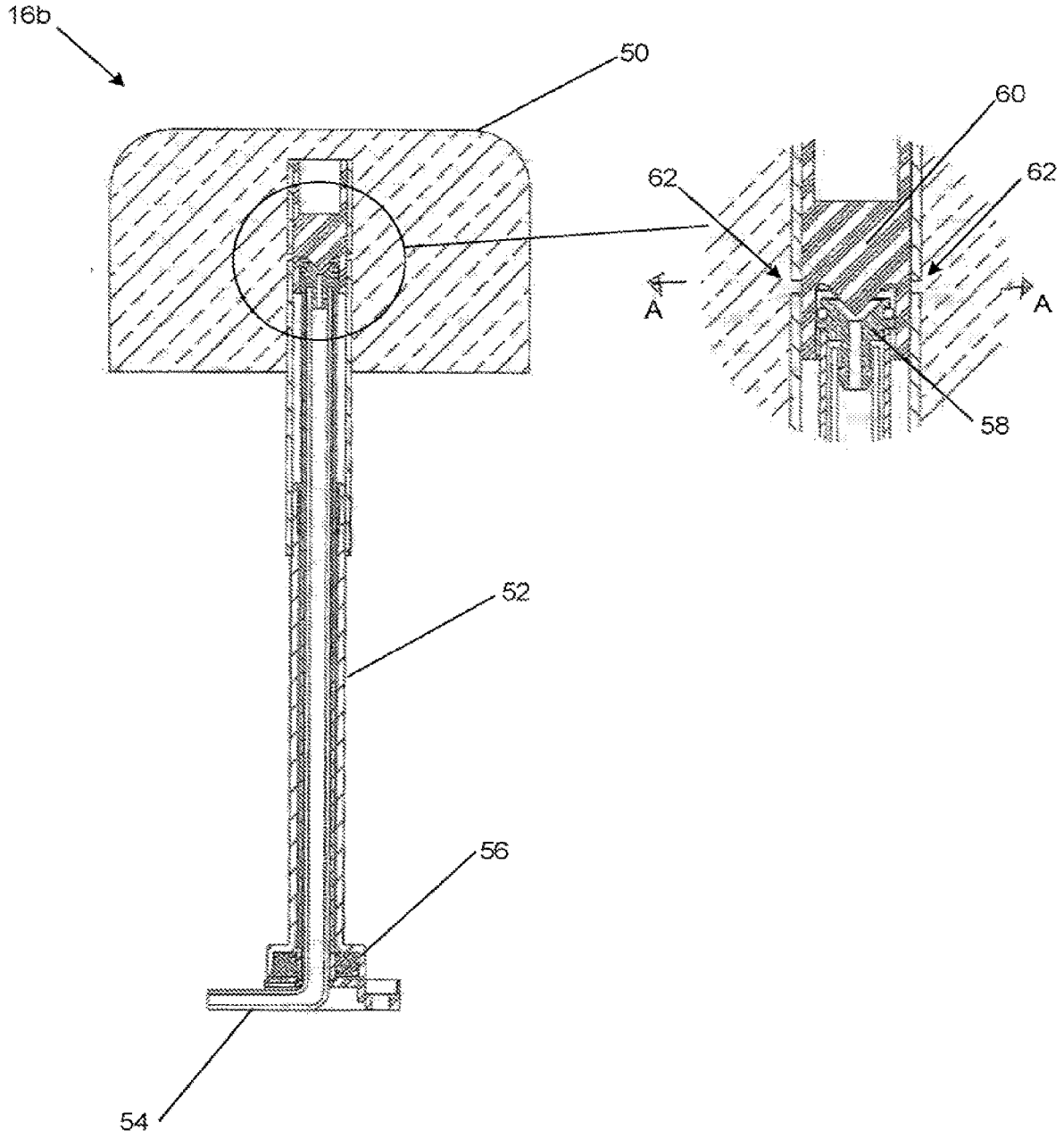
FIG. 11 is an axial sectional view of a shaft for supporting a cleaning element with a magnified view of a diffuser for controlling the introduction of steam into the device in a first position.

FIG. 11 illustrates unswitched cleaning element 16*b* in further detail. It will be appreciated that cleaning elements 16*d*, 16*e* may be similarly configured. Cleaning element 16*b* includes a cleaning head 50 for engaging the item to be polished, in this case a glass. The cleaning head 50 is formed of flexible filaments, which may be cotton, that are urged outwardly during rotation. In other embodiments, the cleaning elements may be formed of other materials, such as plastic foams for example. The cleaning head 50 is mounted on a shaft 52 that rotates about steam pipe 54. A bearing 56 may be provided to support the shaft 52.

At the top of the steam pipe 54 is a nozzle 58 that directs steam onto a conical diffuser 60, which rotates with the cleaning head 50, for directing steam radially outwardly along path A from the steam pipe 54 via apertures 62 formed in shaft 52. Steam flows through apertures 62 and into cleaning head 50 to facilitate drying and polishing of the glass. The apertures are preferably two apertures offset 180 degrees around the shaft, i.e. on opposite sides of the shaft, though they may also be otherwise configured with a single aperture or more than two apertures. Although a single set of apertures is provided at a mid point of the cleaning element, it will be appreciated that they may be offset from the mid point, and that more that one set of apertures may be provided.

Figure 13:
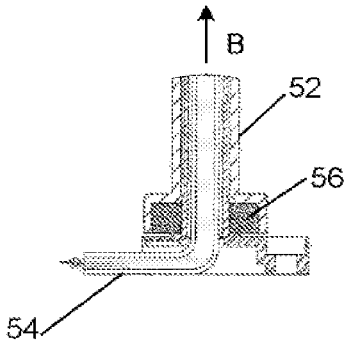
FIG. 13 is an axial sectional view of a base of a shaft for supporting a cleaning element.

On activation of the steam distribution system 34, steam flows from the boiler 38, via the conduit 40, into steam pipe 54 and upwardly along path B, as illustrated in FIG. 13.

Figure 12:
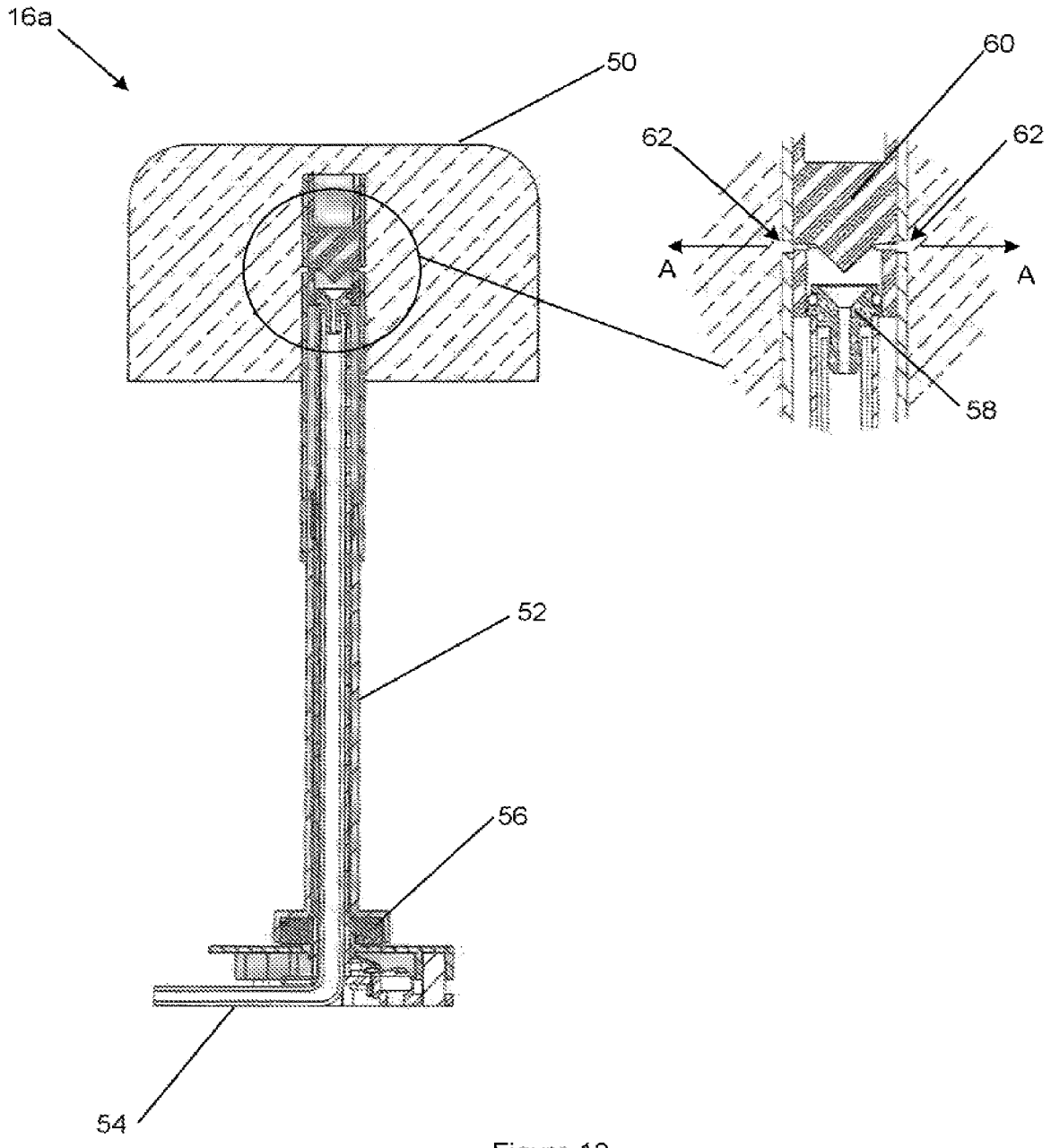
FIG. 12 is an axial sectional view of another shaft with a magnified view of a diffuser for controlling the introduction of steam into the device in a second position.

FIG. 12 illustrates a switched cleaning element 16*a* in further detail. It will be appreciated that cleaning element 16*c* may be similarly configured. Again, cleaning element 16*a* includes a cleaning head 50 for engaging the item to be polished, in this case a glass. The cleaning head 50 is formed of flexible filaments, which may be cotton, that are urged outwardly during rotation. In other embodiments, the cleaning elements may be formed of other materials, such as plastic foams for example. The cleaning head 50 is mounted on a shaft 52 that rotates about steam pipe 54. A bearing 56 may be provided to support the shaft 52.

Again, at the top of the steam pipe 54 is a nozzle 58 that directs steam onto a conical diffuser 60, which rotates with the cleaning head 50, for directing steam radially outwardly along path A from the steam pipe 54 via apertures 62 formed in the steam pipe 54. Steam flows through apertures 62 and into cleaning head 50 to facilitate drying and polishing of the glass. Although a single set of apertures is provided at a mid point of the cleaning element, it will be appreciated that they may be offset from the mid point, and that more that one set of apertures may be provided.

Figure 14:
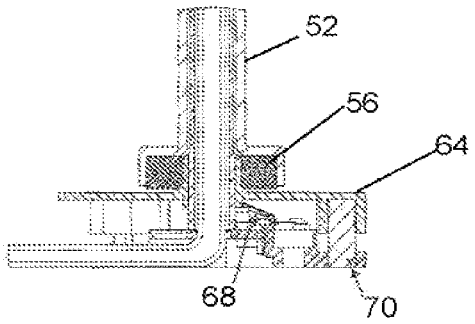
FIG. 14 is a side sectional view of another base.
Figure 15:
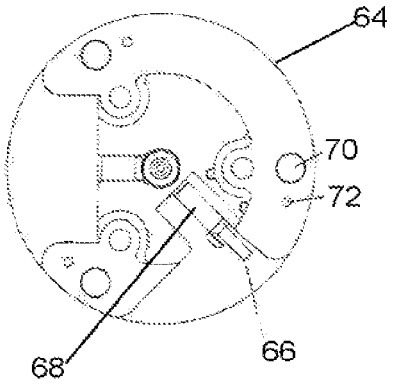
FIG. 15 is a bottom view of the base.

With switched cleaning elements 16*a*, 16*c*, the steam distribution system 34 is operable by applying pressure to the cleaning element 16*a* via the cleaning head 50 axially along the axis of rotation of the cleaning element 16*a* to trigger steam flow to all of the cleaning elements in the first set, i.e. 16*a*, 16*b*, 16*c*, 16*d*, 16*e*. FIGS. 14 and 15 illustrate how this is achieved. In this regard, a base plate 64 is provided, the base plate 64 being movable axially along the steam pipe 54 when shaft 52 is depressed. A switch 66 is provided between the base plate 64 and a base of the device 10, whereby applying pressure to the cleaning head 50 causes depression of a switch arm 68 and activation of switch 66, triggering control valve 44*b* to be opened so that steam can flow toward cleaning elements 16*a*, 16*b*, 16*c*, 16*d*, 16*e*.

A spring 70 is provided to resiliently bias the base plate 64 and thus the shaft 52 and cleaning head 50 upwardly, though allow it to be movable downwardly to operate the steam distribution system. A bolt 72 is provided for guiding movement of the brush.

Cleaning elements 16*f*, 16*g*, which are configured to dry and polish cutlery, may be unswitched cleaning elements and configured in accordance with cleaning elements 16*b*, 16*d*, 16*e*, as described above. Operation of the steam distribution system 34 for flow of steam to cleaning elements 16*f*, 16*g* via control valve 44*a* may be via a further sensor within the enclosure, such as a proximity sensor to detect the insertion of cutlery, to provide autonomous activation of steam once a piece of cutlery is inserted through the aperture and held in place by the user to hygienically clean/polish the piece of cutlery prior to use. Alternatively, an external switch on or remote from the device 10 may be provided.

The device 10 also includes a programmable microprocessor that can control operation, monitor performance parameters, and log usage data. In one example, the microprocessor can record usage history and provide alerts for replacement of the cleaning elements 16 once a predetermined number of cycles have passed. In other examples, the microprocessor may accept signals from sensors fitted to the device, such as vibration sensors to alert to damage of cleaning elements, which could shut down or limit operation of the device, or moisture sensors to alert to excessive use of steam, which could trigger operation of a heater provided within the enclosure for drying the cleaning elements.

Figure 16:
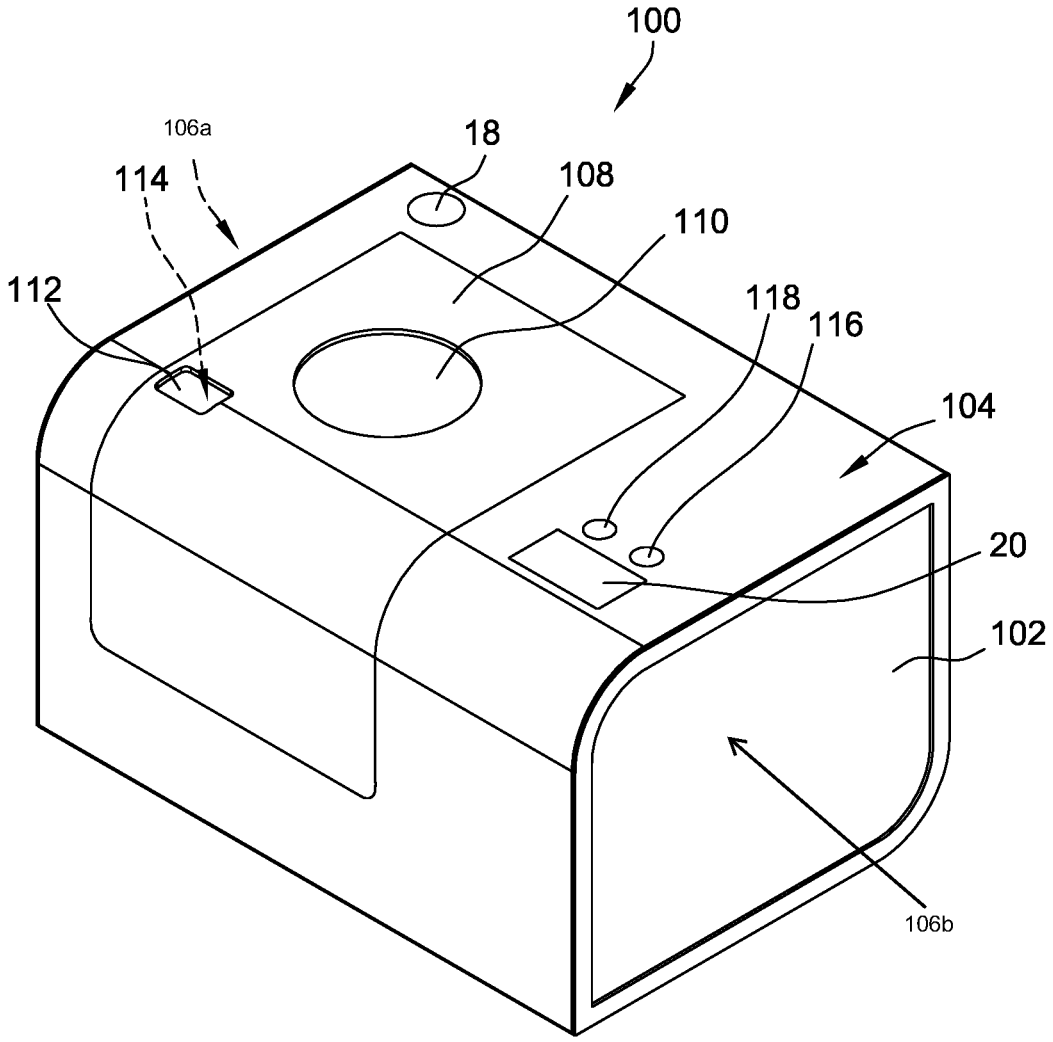
FIG. 16 is a perspective view of a device of another embodiment of the disclosure.

With reference to FIG. 16, there is shown a device 100 for drying and polishing items such as glasses and cutlery according to a second preferred embodiment of the disclosure.

Device 100 is substantially similar to device 10. That is, device 100 includes substantially the same components (e.g., cleaning elements 16, rotating assembly 32, a steam distribution system 34, etc.) as device 10 and performs in substantially the same way as device 10 (e.g., by using the steam distribution system and cleaning elements to dry and/or polish the items). Accordingly, like components of device 10, that are included in the description of device 100, will be identified by the the same reference numerals as used in the description of device 10. However, device 100 includes additional features of an integrated device for drying and/or polishing glasses and cutlery in a single device and where the cutlery is cleaned with minimal contact by the user, as is further described herein.

Device 100 includes an enclosure 102 (e.g., substantially similar to enclosure 12 of device 10) that defines a chamber 103 (shown in FIG. 18), a top portion 104, and side portions 106*a*, 106*b* adjacent to the top portion 104. Device 100 further includes a lid 108 (e.g., substantially similar to lid 22 of device 10) disposed on the top end 104 of the device 100. The lid 108 may be selectively opened and closed by the user. The lid 108 includes a first aperture 110 (e.g., substantially similar to the first aperture 14*b* of the device 10) and a second aperture 112. A third aperture 122 is located along side portion 106*a*. The first aperture 110 is configured to receive a first item (e.g., a stemware item) for drying and/or polishing. That is, the first aperture 110 has a size and shape complementary to the first items such that an end of the first items (e.g., a cup portion or a stem portion of stemware items) can be placed in the aperture 110 for drying and/or polishing by the cleaning elements 16, as described herein. In the present disclosure, aperture 110 includes a complementary circular configuration. The second aperture 112 is configured to fully receive a second item (e.g., a cutlery item) for drying and/or polishing the items without the user being required to hold the second item while the device 100 polishes and/or dries the second item. That is, the second aperture 112 has a size and shape complementary to the second items such that the second items can be fully inserted singly into the enclosure 102 and the chamber 103 through the second aperture 112 for polishing and/or drying of the second items, as described herein.

A channel assembly 114 extends internally (e.g., in the chamber 103) through the device 100 from the second aperture 112 of the top portion 104 to the third aperture 122 formed in side portion 106*a*. The channel assembly 114 is configured to guide the items inserted into the second aperture 112 through the enclosure 102 and the chamber 103, as described further herein.

Device 100 further includes the operation switch 18, the display screen 20, and a first button 116 and a second button 118 associated with the display screen 20. In the exemplary embodiment, the buttons 116, 118 may be used to navigate and/or view the display screen 20. In other embodiments, the display screen 20 may be a conventional touchscreen device/graphical user interface, and the buttons 116, 118 may not be included in device 100.

Device 100 is configured to be relatively compact and lightweight such that device 100 has a small footprint and does not take up a large amount of space on the surface (e.g., a countertop of a kitchen) upon which device 100 is placed and is able to be moved by a user without substantial effort or moving equipment. Since counter space may be limited in kitchens and/or bars, especially commercial kitchens and bars, the compact and lightweight device 100 is preferable to large and heavy machinery that polishes and/or dries items. For example, device 100 may be put on a countertop when device 100 is being used and then easily stored away when device 100 is not in use to clear the countertop. Accordingly, device 100 may be preferable to other polishing and drying devices that are permanent or semi-permanent fixtures of kitchens and bars due to the size and weight of the other polishing and drying devices. Further, device 100 provides polishing and drying for both stemware/glasses and cutlery in the single enclosure 102 of device 100, and separate devices are not needed for stemware and cutlery polishing and drying. That is, a user of the device can polish and/or dry a stemware item (e.g., by holding the stemware item proximate to the first aperture 110) while the user is simultaneously placing cutlery items (e.g., into second aperture 112) into device 100 to be polished and/or dried, as described herein. Integrating the cutlery and glass polishing/drying capability into a single device eliminates the need to have separate discrete devices dedicated to cleaning of stemware or cutlery.

Figure 17:
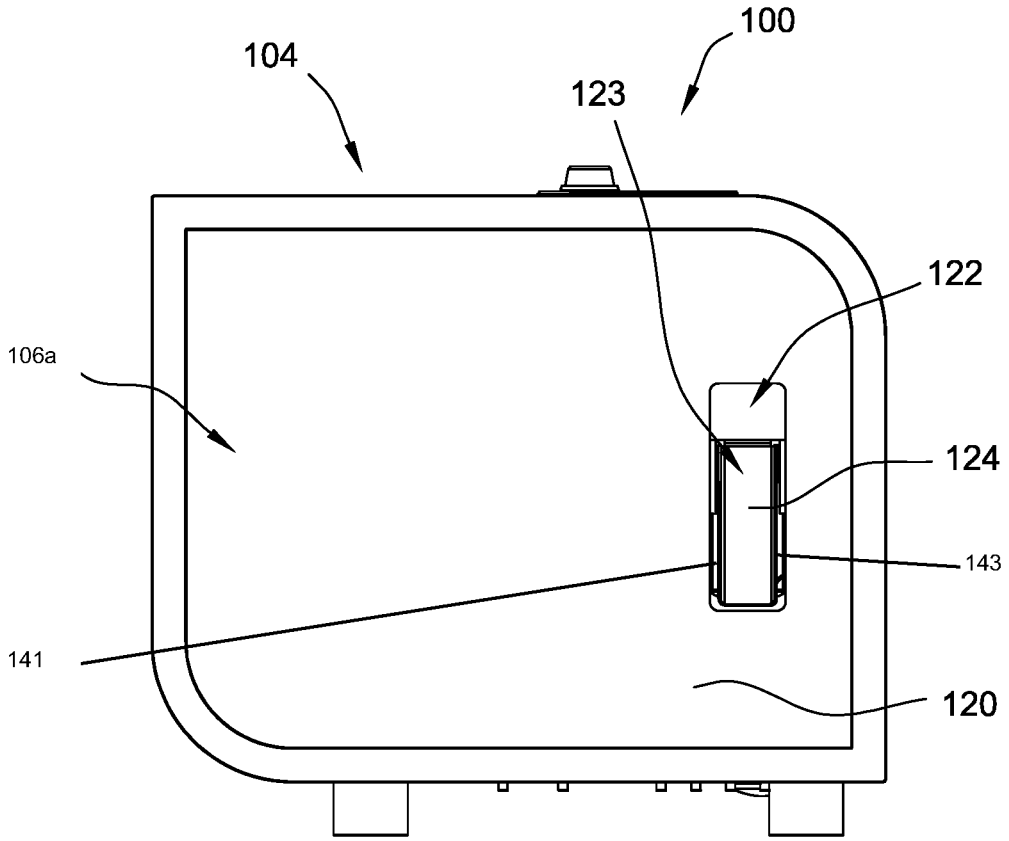
FIG. 17 is a side view of the device shown in FIG. 16.

FIG. 17 shows a side view of device 100. Specifically, FIG. 17 shows the side portion 106*a* of device 100. Side portion 106*a* includes a side panel 120. The side panel 120 includes third aperture 122 therein, and the third aperture 122 is adapted to receive a discharge end 123 of the channel assembly 114. Specifically, the third aperture 122 is configured to receive a chute 124 of the channel assembly 114 located proximate the discharge end 123 of the channel assembly 114. Edges 141, 143 of the chute 124 substantially align with the third aperture 122. Comparing apertures 112 and 122, third aperture 122 has a larger area than second aperature 112. When cutlery is inserted singly by the user into the second aperture 112, the larger area of the third aperture 122 enables the effective discharge from the channel assembly 114 and out of the enclosure 102. That is, the channel assembly 114 extends from the second aperture 112 of the top portion 104 of device 100 to the third aperture 122 of the side portion 106*a* of device 100. The discharge end 123 and the chute 124 are located within the third aperture 122, and the edges 141, 143 of the chute 124 substantially align with the third aperture 122.

Although the apertures 110, 112, 122 are illustrated in FIGS. 16 and 17 as being in specific locations on the enclosure 102 of device 100, it should be understood that, in other embodiments, apertures 110, 112, 122 may be in any suitable location on the enclosure 102 of device 100. For example, in other embodiments, the third aperture 122 may be on side portion 106*b* or on a bottom portion of the device 100.

Figure 18:
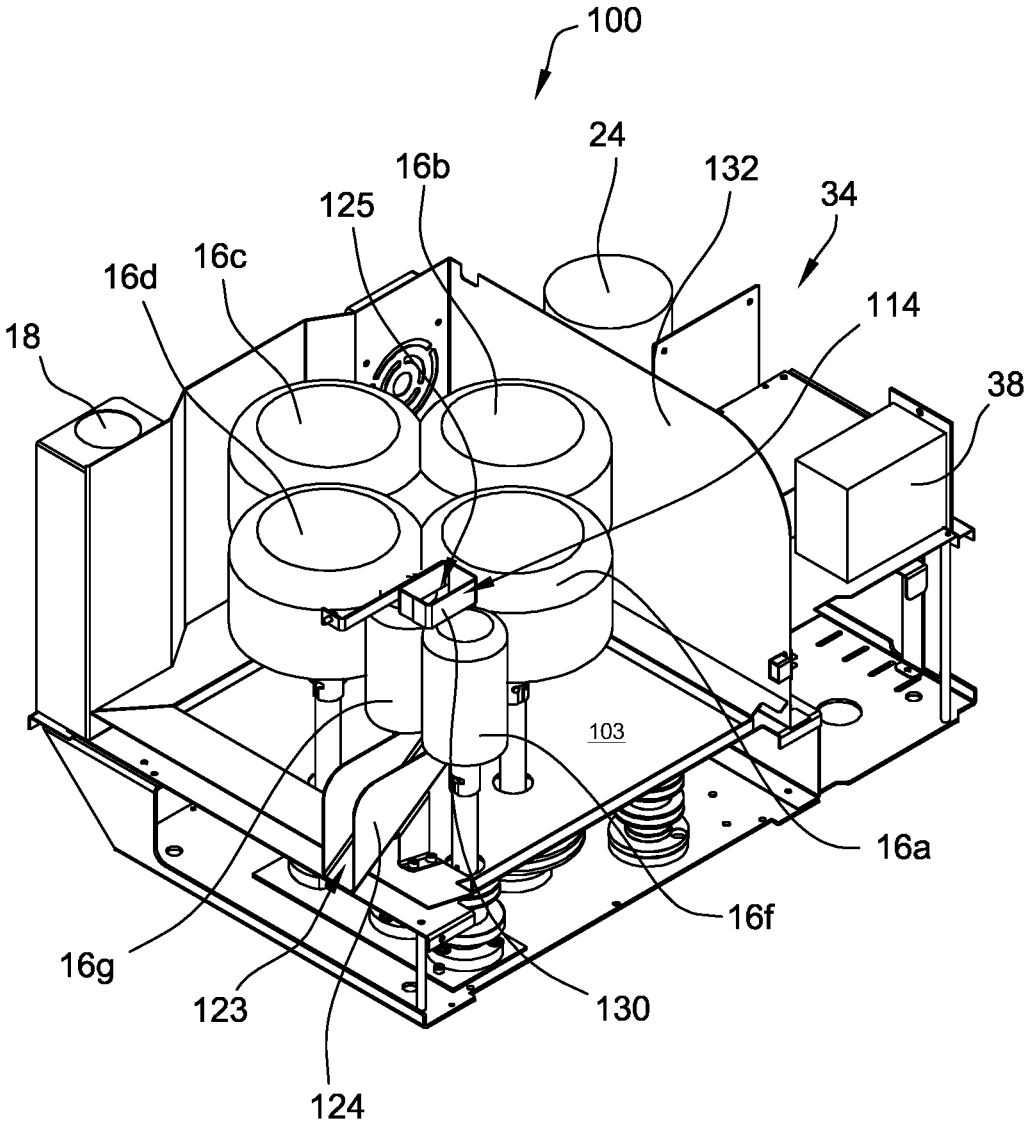
FIG. 18 is a perspective view of the device shown in FIG. 16 with the cover and enclosure removed.
Figure 19:
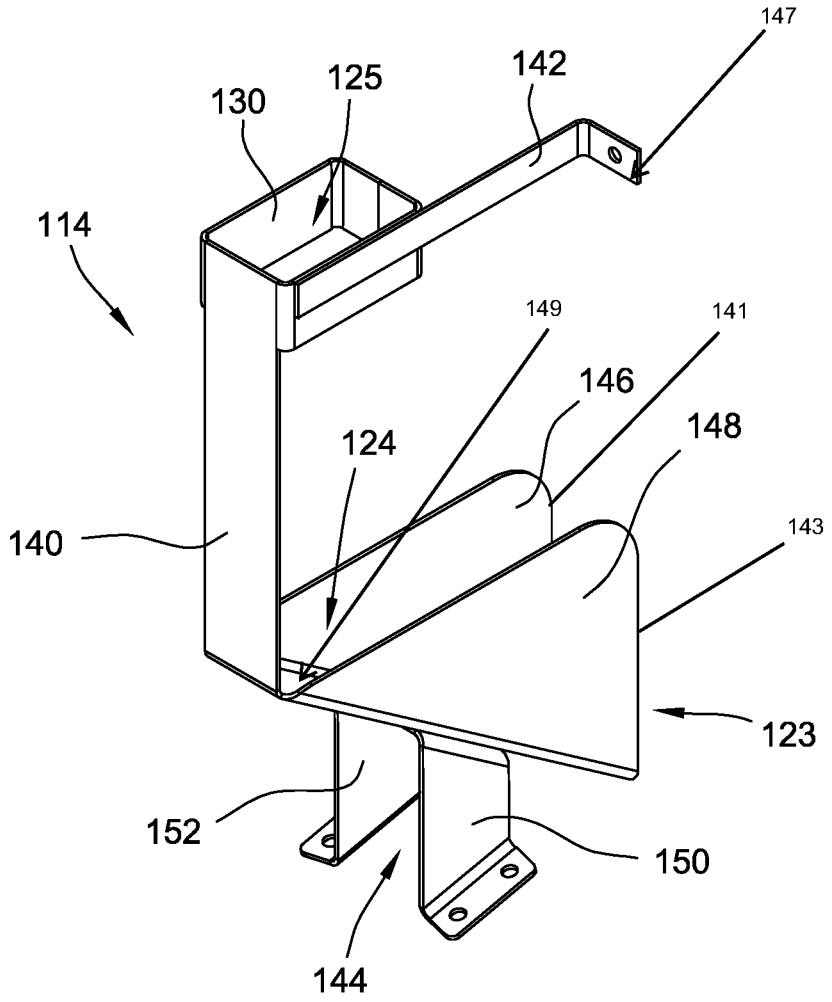
FIG. 19 is a perspective view of a channel assembly used in the device shown in FIG. 18.

FIG. 18 shows a perspective view of device 100 without the enclosure 102, and FIG. 19 shows a perspective view of the channel assembly 114 of device 100. That is, FIG. 18 shows a perspective view of the chamber 103 and the internal components of the device 100. As shown in FIG. 18, the internal components of device 100 are substantially similar (e.g., in design and function) to the internal components of device 10, as shown in FIGS. 2 and 5, for example. However, the device 100 includes the channel assembly 114, and the cleaning elements 16*f* and 16*g* are (i) disposed near the side portion 106*a* (shown in FIG. 16) of the device 100 and (ii) adjacent to the channel assembly 114, and (iii) between the apertures 112, 122. In the exemplary embodiment, the cleaning elements 16*a*-16*e* (also referred to herein as "the first cleaning element(s)") are proximate the first aperture 110 of the enclosure 102 of device 100 and are configured to clean, dry, and/or polish the stemware items received through the first aperture 110. The cleaning elements 16*f*, 16*g* (also referred to herein as "the second cleaning element(s)") are proximate the second and third apertures 112, 122 of the enclosure 102 of device 100 and are configured to clean, dry, and/or polish the cutlery items received through the second aperture 112 as the cutlery items are guided through the chamber 103 by the chute assembly 114.

Device 100 includes substantially similar electronic components as device 10. For example, device 100 includes at least one of the electric drive 24, the steam distribution system 34, a boiler 38 for heating the water of the steam distribution system 34, and other electrical components of device 10 not specifically shown with respect to device 100, including, but not limited to, the rotating assembly 32, the water reservoir 36, the main water connection 37, the pump 42 of the steam distribution system 34, and other suitable components that allow devices 10 and 100 to function as described herein.

Device 100 includes a wall 132 that is configured to separate the cleaning elements 16 from the electrical components. The wall 132 protects the electrical components of device 100 from the steam emitted from the cleaning elements 16 in the polishing and/or drying of the items inserted into the enclosure 102 (shown in FIG. 16) of device 100. That is, the wall 132 is configured to inhibit the steam generated in the polishing and/or drying of the items from interfering with the functions of the electrical components. With the enclosure 102 in place, the top portion 104 of the enclosure 102 is in contact with a top edge of the wall 132, and the wall 132 and the enclosure 102 form the chamber 103 for the cleaning elements. The contact between the wall 132 and the enclosure 102 impedes the flow of steam outward from the chamber 103 and into the area of device 100 that contains the electronic elements.

As shown in FIGS. 18 and 19, the unitary channel assembly 114 comprises a collar 130 that defines an inlet opening 125, a support member 140 including a first end connected to the collar 130 and a second end joined to one end of the chute member 124 (e.g., the end opposite the discharge end 123). The chute 124 extends away from the support member 140 and is sloped downward, away from the inlet 125 as it extends from the support member 140. The discharge end 123 of the chute 124 is located proximate the third aperture 122 when the channel assembly 114 is located for use in device 100. The chute member 124 includes two parallel guide members 146 and 148, and the parallel guide members 146, 148 include the edges 141 and 143, respectively, located at the discharge end 123 of the chute 124. The guide members 146, 148 extend upwardly from the chute member 124 between the support member 140 and the edges 141, 143. In use, the edges 141, 143 of the guide members 146, 148 are located in third aperture 122, and as a result, serve to effectively locate the channel assembly 114 in the enclosure 102. The collar 130, support member 140, chute 124, and guide members 146, 148 define a path 149.

An anchor member 142 is made integral with the collar 130. In the exemplary embodiment, the anchor 142 is an L-shaped member. A free end 147 of the anchor member 142 is fixed in a conventional manner to an interior of side portion 106*a* near the top portion 104 of the enclosure 102 when the channel assembly 114 is located in the chamber 103. Screws, or other well-known fasteners may be used to join the free end 147 of the anchor member 142 to the enclosure 102.

A second anchor member 144 is made integral with chute 124 and includes a first leg 150 and a second leg 152. In the exemplary embodiment, the second anchor member 144 is U-shaped. The second anchor member 144 secures the channel assembly 114 to the enclosure 102 along a floor of the enclosure 102 (e.g., the floor of the enclosure being substantially parallel to the top portion 104 of the enclosure 102, shown in FIG. 16). Like anchor 142, anchor member 144 may be secured to the enclosure 102 in the respective areas of the device 100 by any suitable securement means, including, but not limited to, a screw, nuts and bolts, and/or welding.

Accordingly, when located for use in the chamber 103, the first anchor member 142 of the channel assembly 114 is secured in the enclosure 102 of the device 100 such that (i) the collar 130 and associated defined inlet 125 is adjacent the second aperture 112 of the device 100 and (ii) the discharge end 123 of the chute assembly 114 is adjacent the third aperture 122 with the guides 146, 148 adjacent the third aperture 122 (as shown in FIG. 17) of device 100. The collar 130 is configured to complement the size and shape of the second aperture 112 of the top portion 104 of the device 100. The chute 124 is configured to fit within the third aperture 122 of the side panel 120 of device 100. Further, the support member 140 is adjacent to the cleaning elements 16*f*, 16*g*.

In use, cutlery, such as forks, knives and/or spoons may be inserted through inlet 125 and second aperture 112 into chamber 103. Upon entry into the chamber 103, the specific cutlery item is located along the portion of the path 149 defined by the support 140. The cutlery item then moves through the cleaning elements 16*f*, 16*g* where the item is polished and/or dried. After passing through the cleaning elements 16*f*, 16*g*, the cutlery item continues along the portion of the path 149 defined by the chute 124 and ultimately exits (e.g., is discharged from) the chamber 103 through third aperture 124. The guide members 146, 148 ensure that as the cutlery item emerges from the cleaning elements 16*f*, 16*g*, it is maintained on the defined path 149 and out the third aperture 122. The guides 146, 148 span the entire length of the chute 124, from the cleaning elements 16*f*, 16*g* to the discharge end 123. In some embodiments, as the cutlery exits the chamber 103, the cutlery may be collected in a receptacle (not shown) located near the third aperture 122, thereby further minimizing contact with the cleaned cutlery. In other embodiments, a user may receive the polished and/or dried cutlery items as the cutlery items descend from the chute 124 and out of the chamber 103.

With the addition of the channel assembly 114 of the device 100, the device 100 can automatically polish and/or dry, by the cleaning elements 16*f*, 16*g*, the cutlery items inserted into the second aperture 112 of the top portion 104 of device 100. That is, device 100 embodies a "touchless" system for polishing and/or drying cutlery items. The user of device 100 does not have to hold the items in contact with the cleaning elements 16*f*, 16*g* while the cleaning elements 16*f*, 16*g* polish and/or dry the cutlery items. Rather, the user of device 100 may insert the cutlery items in the second aperture 112 of the top portion 104 of the device 100 and retrieve the inserted cutlery items from the third aperture 122 of the side panel 120 of device 100. Accordingly, the "touchless" polishing and/or drying functionality of device 100 provides a sanitary, fast, and efficient way for users to polish and/or dry cutlery items.

Figure 20:
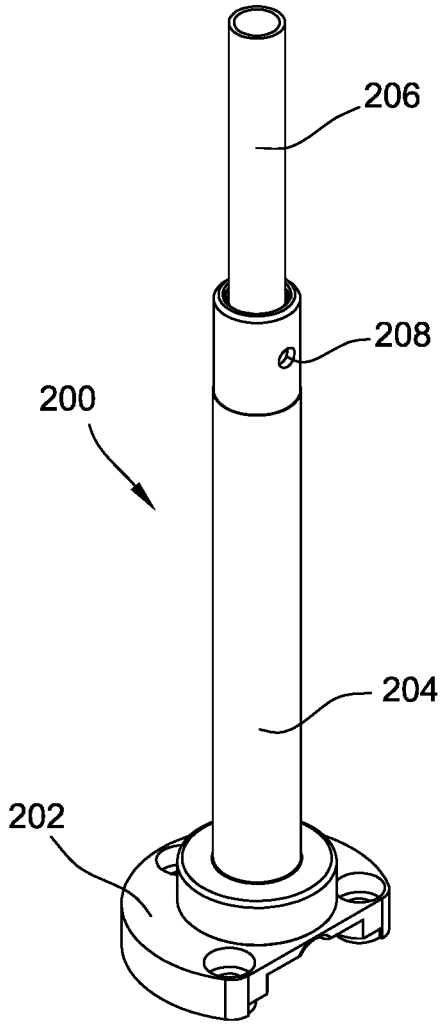
FIG. 20 is a perspective view of a steam generating assembly of the device shown in FIG. 18.

FIG. 20 shows an exemplary embodiment of a steam generating component 200 of the cleaning elements 16. The steam generating component 200 is substantially similar to the steam generating component of the cleaning elements 16*b* and 16*a*, described with respect to FIGS. 11, 12, and 14 above. That is, the steam generating component 200 includes a base 202 (e.g., substantially similar to base plate 64 of FIG. 14), a steam shaft 204 (e.g., substantially similar to the shaft 52 of FIGS. 11 and 12), a steam pipe 206 (e.g., substantially similar to the steam pipe 54 of FIGS. 11 and 12), and a steam aperture 208 (e.g., substantially similar to the apertures 62 of FIGS. 11 and 12) formed in the steam shaft 204. Like as described with respect to FIGS. 11, 12, and 14, the steam shaft 204 rotates about the steam pipe 206, and steam is directed radially outward from the steam pipe 206 through the apertures 208. As described with respect to FIGS. 11 and 12, the steam generating component 200 preferrably includes two apertures 208, located 180 degrees from each other on the steam shaft 204.

Figure 21:
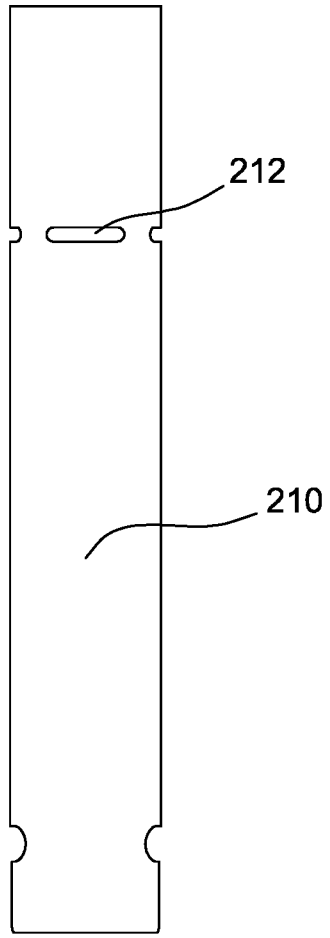
FIG. 21 is a side view of a glass tube used in the steam generating assembly shown in FIG. 20.
Figure 22:
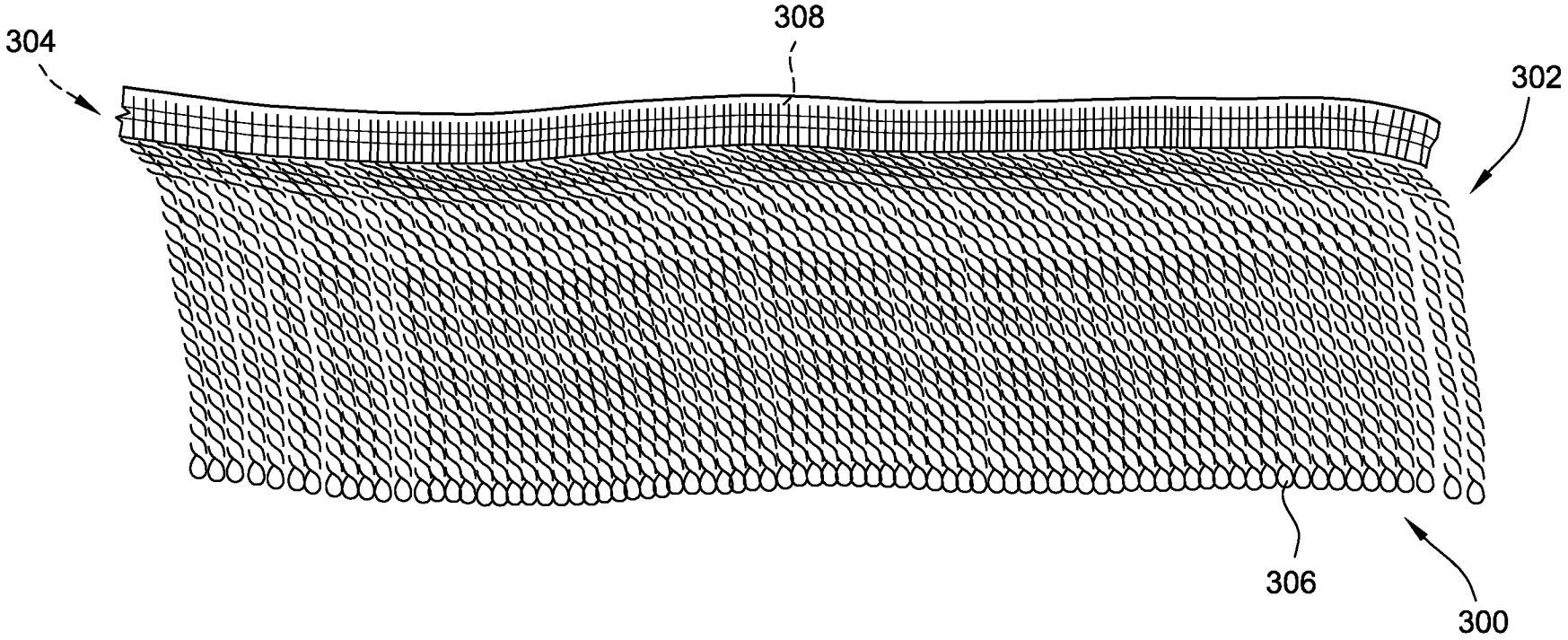
FIG. 22 is a side view of a band of a plurality of brush tassels.
Figure 23:
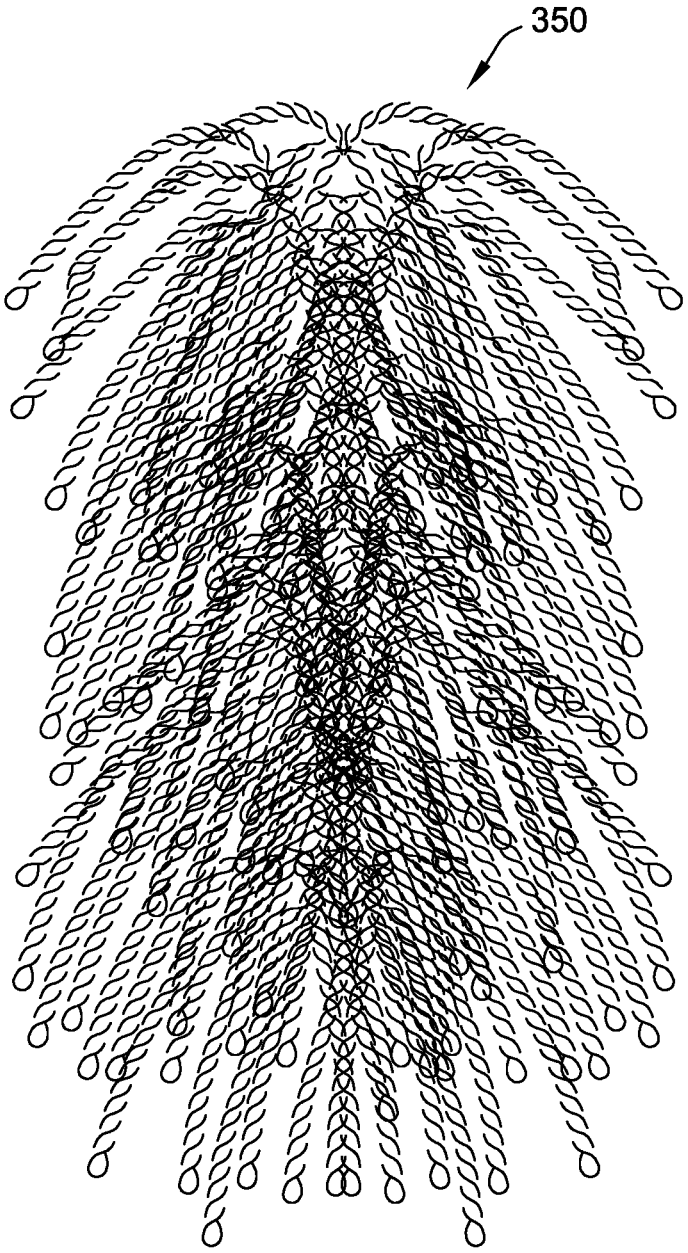
FIG. 23 is a side view of a brush head assembly including the glass tube shown in FIG. 21 and the band shown in FIG. 22 as used in the device shown in FIG. 18.

FIGS. 21-23 show components of a brush head assembly 350 of the cleaning elements 16. FIG. 21 shows a side view of a glass tube 210, FIG. 22 shows a side view of a band 300, and FIG. 23 shows a side view of the brush assembly 350.

In the exemplary embodiment, the brush head assemblies 350 of each of the cleaning elements 16*a-g* are substantially similar. Accordingly, only one brush head assembly 350 is illustrated, and it should be understood that in the exemplary embodiment, the brush head assembly 350 represents the brush head assemblies 350 for each of the cleaning elements 16*a-g*. In other embodiments, the brush head assemblies 350 of the cleaning elements 16*a-g* may differ from one another. For example, in one embodiment, the cleaning elements 16*a-e* may include larger brush head assemblies 350 compared to the brush head assemblies 350 of the cleaning elements 16*f*, 16*g*.

The glass tube 210 includes two apertures 212 disposed 180 degrees from each other on the glass tube 210. The glass tube 210 is configured to be disposed around the steam shaft 204 of the steam generating component 200. The apertures 212 of the glass tube 210 are configured to align with the apertures 208 of the steam shaft 204 when the glass tube 210 is disposed around the steam shaft 204. That is, when the steam flows radially outward from the steam pipe 206, the steam flows through the apertures 208 of the steam shaft and the apertures 212 of the glass tube of the brush head assembly 350.

The band 300 includes a front end 302 and a back end 304 opposite the front end 302. The band 300 includes a plurality of brush tassels 306 sewn or otherwise joined together to form the band 300. In the exemplary embodiment, the brush tassels 306 are comprised of a mix of fibers of cotton, rayon, and polyester. In other embodiments, the brush tassels are comprised of any suitable fibers or materials including, for example, foam. The band 300 includes an adhesive 308 adhered to the back end 304 of the band 300. In the exemplary embodiment, the adhesive 308 is a double-sided cloth tape. In other embodiments, the adhesive 308 is any suitable adhesive including, for example, glue, hook-and-loop fasteners, and resins.

The brush head assembly 350 includes the glass tube 210 and the band 300 of the plurality of brush tassels 306. Specifically, the brush assembly 350 is formed from the band 300 being adhered to the glass tube 210 with the adhesive 308 of the band 300. The band 300 is wound tightly around the glass tube 210, except in the areas of the apertures 212 of the glass tube 210. That is, the band 300 is not adhered to the apertures 212 of the glass tube 210. Accordingly, the brush assembly 350 is disposed around the steam generating component 200 such that steam flows from the steam generating component 200 through the apertures 212 and brush assembly 350. The steam and the rotation of the plurality of brush tassels 306 polish and/or dry the items inserted into the enclosure 102 of the device 100 (both shown in FIG. 16), as described above with respect to the cleaning elements 16.

The embodiments have been described by way of example only and modifications are possible within the scope of the disclosure disclosed. For example, in the illustrated embodiments, the cleaning elements 16 are rotatable for cleaning or polishing the items. In other embodiments, the direction of motion may change rapidly with the cleaning elements 16 oscillating. In other embodiments, the cleaning elements may also demonstrate axial movement, or combinations or rotation, oscillation and axial translation. Furthermore, although the cleaning elements are described as being formed of flexible filaments that are urged outwardly during rotation, they may also be formed of other materials, such as plastic foams for example.

The invention claimed is:

1. A device for drying and polishing a plurality of items, the device comprising:

a plurality of movable cleaning elements configured to at least one of dry and polish the items, the plurality of movable cleaning elements including at least one first movable cleaning element configured to at least one of dry and polish a first item of the plurality of items, and at least one second movable cleaning element configured to at least one of dry and polish a second item of the plurality of items; and an enclosure defining a chamber, wherein the at least one first movable cleaning element and the at least one second movable cleaning element are located in different positions in the chamber, and wherein the enclosure comprises:

a first aperture at a first enclosure location, the first aperture adapted to receive the first item, wherein the at least one first movable cleaning element is proximate the first aperture to at least one of polish and dry the first item when the first item is inserted into the chamber through the first aperture;

a second aperture at a second enclosure location, the second aperture adapted to enable the second item to be inserted into the chamber;

a third aperture at a third enclosure location, the third aperture adapted to enable the second item to exit the chamber; and a channel assembly located in the chamber, the channel assembly defining a channel path, the channel path extending between the second aperture and the third aperture, wherein the at least one second movable cleaning element is located proximate the channel assembly, and wherein the second item is at least one of polished and dried by the at least one second movable cleaning element as the second item moves along the channel assembly path between the second and third apertures.

2. The device according to claim 1, wherein the device further includes:

a top portion, wherein a lid is disposed on the top portion, and wherein the lid includes the first and second apertures; and a side portion including a side panel, wherein the side panel includes the third aperture.

3. The device according to claim 2, wherein the channel assembly includes a collar, a support member, and a chute including parallel guide members, wherein the collar surrounds an inlet opening, and wherein the chute includes a discharge end.

4. The device according to claim 3, wherein the collar is adjacent to the second aperture, wherein the chute is adjacent to the third aperture, and wherein the parallel guide members of the chute are proximate the third aperture.

5. The device according to claim 4, wherein the chute is angled away from the inlet opening as the chute extends from the support member and through the third aperture.

6. The device according to claim 1, wherein the at least one first movable cleaning element is a plurality of first movable cleaning elements, and wherein the at least one second movable cleaning element is a plurality of second movable cleaning elements.

7. The device according to claim 1, wherein the first item and the second item are at least one of a stemware item and a cutlery item.

8. The device according to claim 1 further comprising:

a selectively operable steam distribution system for applying steam within the enclosure to at least one of (i) at least one of the plurality of movable cleaning elements and (ii) the first and second items inserted into at least one of the first and second apertures, wherein the steam distribution system is operable upon insertion of the items into at least one of the first and second apertures.

9. The device according to claim 8, wherein the movable cleaning elements are rotatable for at least one of polishing and drying the items, and wherein the steam distribution system is operable by applying pressure to the movable cleaning elements axially along their axis of rotation.

10. The device according to claim 9, wherein at least one of the movable cleaning elements is mounted on a rotatable shaft, the shaft rotating around a steam pipe extending through the shaft and terminating at a steam nozzle formed by apertures in the shaft intermediate of its length, and wherein a conical diffuser is disposed at an end of the steam pipe to direct steam radially outwardly from the steam pipe and into the movable cleaning element.

11. The device according to claim 1, wherein each of the plurality of movable cleaning elements includes a brush head assembly formed from a plurality of brush tassels.

12. A device for drying and polishing a plurality of items, the device comprising:

a plurality of movable cleaning elements configured to at least one of dry and polish the items, the plurality of movable cleaning elements including at least one first movable cleaning element configured to at least one of dry and polish a first item of the plurality of items, and at least one second movable cleaning element configured to at least one of dry and polish a second item of the plurality of items, an enclosure defining a chamber, wherein the at least one first movable cleaning element and the at least one second movable cleaning element are located in different positions in the chamber, and wherein the enclosure comprises:

a first aperture at a first enclosure location, the first aperture adapted to receive the first item, wherein the at least one first movable cleaning element is proximate the first aperture to at least one of polish and dry the first item when the first item is inserted into the chamber through the first aperture;

a second aperture at a second enclosure location, the second aperture adapted to enable the second item to be inserted into the chamber;

a third aperture at a third enclosure location, the third aperture adapted to enable the second item to exit the chamber; and a channel assembly located in the chamber, the channel assembly defining a channel path, the channel path extending between the second aperture and the third aperture, wherein the at least one second movable cleaning element is located proximate the channel assembly, and wherein the second item is at least one of polished and dried by the at least one second movable cleaning element as the second item moves along the channel assembly path between the second and third apertures; and a selectively operable steam distribution system configured to apply steam within the chamber to at least one of (i) the at least one of the first and second movable cleaning elements and (ii) the items inserted into at least one of the first and second apertures, wherein the steam distribution system is operable upon insertion of the items into at least one of the first and second apertures.

13. The device according to claim 12, wherein the channel assembly includes a collar, a support member, and a chute including parallel guide members, wherein the collar surrounds an inlet opening, and wherein the chute includes a discharge end.

14. The device according to claim 13, wherein the channel path is defined by the collar, the support member, and the chute of the channel assembly.

15. The device according to claim 12, wherein the device further comprises a plurality of electronic components within the enclosure, wherein the plurality of electronic components include at least one of the steam distribution, an electric drive, a boiler, a rotating assembly, a water reservoir, a main water connection, and a pump.

16. The device according to claim 15 further comprising a wall, wherein the wall is configured to separate the first and second movable cleaning elements of the chamber from the plurality of electronic components of the enclosure.

17. The device according to claim 12 further comprising a programmable microprocessor, wherein the microprocessor is configured to record usage history and provide alerts for replacement of the first and second movable cleaning elements once a predetermined number of cycles have passed.

18. The device according to claim 12, wherein each of the plurality of movable cleaning elements includes a brush head assembly formed from a plurality of brush tassels.

* * * * *